US010167616B2

(12) United States Patent
Floyd

(10) Patent No.: US 10,167,616 B2
(45) Date of Patent: Jan. 1, 2019

(54) METHOD OF COUPLING A PIT EXTENSION TO A PIT LINER OF A PIT VAULT

(71) Applicant: Mueller International, LLC, Atlanta, GA (US)

(72) Inventor: Scott P. Floyd, Whitwell, TN (US)

(73) Assignee: Mueller International, LLC, Atlanta, GA (US)

( * ) Notice: Subject to any disclaimer, the term of this patent is extended or adjusted under 35 U.S.C. 154(b) by 0 days.

(21) Appl. No.: 15/972,887

(22) Filed: May 7, 2018

(65) Prior Publication Data

US 2018/0251963 A1 Sep. 6, 2018

Related U.S. Application Data

(62) Division of application No. 15/436,003, filed on Feb. 17, 2017.

(51) Int. Cl.

| | |
|---|---|
| ***E03B 7/09*** | (2006.01) |
| ***E03B 7/07*** | (2006.01) |
| *E03B 7/02* | (2006.01) |

(52) U.S. Cl.

CPC ..... *E03B 7/095* (2013.01); *E03B 7/072* (2013.01); *E03B 7/02* (2013.01)

(58) Field of Classification Search

CPC . E03B 7/095; E03B 7/072; E03B 7/02; G01F 15/14; G01F 15/18; Y10T 137/6695; Y10T 137/6691; Y10T 137/7017; Y10T 137/7071

See application file for complete search history.

(56) References Cited

U.S. PATENT DOCUMENTS

| | | | | |
|---|---|---|---|---|
| 211,164 | A | 1/1879 | Klein | |
| 503,818 | A | 8/1893 | Watt | |
| 620,588 | A | 3/1899 | Hoppes | |
| 627,911 | A | 6/1899 | Estill | |
| 654,615 | A | 7/1900 | Estill | |
| 983,311 | A | 2/1911 | McCreedy et al. | |
| 1,101,908 | A | 6/1914 | Dennison | |
| 1,156,530 | A | 10/1915 | Howell | |
| 1,158,471 | A | 11/1915 | Felstead | |
| 1,832,852 | A | 11/1931 | Bassett | |
| 3,263,853 | A | 8/1966 | Smith | |
| 3,490,637 | A | 1/1970 | Pope | |
| 3,952,908 | A * | 4/1976 | Carson | H02B 1/06 220/3.8 |
| 3,961,528 | A | 6/1976 | Ford | |
| 4,120,519 | A | 10/1978 | Bridges | |
| 4,163,503 | A * | 8/1979 | McKinnon | H02G 9/10 137/371 |

(Continued)

OTHER PUBLICATIONS

Floyd, Scott P.; Non-Final Office Action for U.S. Appl. No. 15/436,003, filed Feb. 17, 2017, dated May 22, 2018, 21 pgs.

(Continued)

*Primary Examiner* — James M Ference

(74) *Attorney, Agent, or Firm* — Taylor English Duma LLP

(57) ABSTRACT

A method of coupling a pit extension to a pit liner of a pit vault can comprise aligning an extension bottom end of the pit extension with a liner top end of the pit liner in an end-to-end facing relationship; bringing a leg of the pit extension into engagement with the pit liner proximate to the liner top end; and attaching the leg to the pit liner.

20 Claims, 7 Drawing Sheets

(56) References Cited

U.S. PATENT DOCUMENTS

| | | | | |
|---|---|---|---|---|
| 4,305,282 | A | 12/1981 | Hunt | |
| 4,333,580 | A | 6/1982 | Sweigart, Jr. | |
| 4,491,232 | A | 1/1985 | Hansen | |
| 4,813,281 | A | 3/1989 | Daghe | |
| 4,902,045 | A | 2/1990 | McGugan et al. | |
| 5,076,456 | A | 12/1991 | Geyer | |
| 5,210,374 | A * | 5/1993 | Channell | G02B 6/4444 174/38 |
| 5,360,131 | A | 11/1994 | Phillips et al. | |
| 5,617,679 | A | 4/1997 | Meyers | |
| 5,747,687 | A | 5/1998 | Edwards et al. | |
| 6,164,131 | A | 12/2000 | Edwards et al. | |
| 6,182,846 | B1 | 2/2001 | Leschinger et al. | |
| 6,362,419 | B1 | 3/2002 | Gallagher et al. | |
| 6,708,839 | B2 * | 3/2004 | Diesterbeck | B65D 1/46 206/508 |
| 6,834,888 | B2 | 12/2004 | Campau | |
| 6,908,004 | B2 | 6/2005 | Barr | |
| 7,004,677 | B1 | 2/2006 | Ericksen et al. | |
| 7,223,051 | B1 | 5/2007 | Vought et al. | |
| 7,243,810 | B2 | 7/2007 | O'Brien et al. | |
| 7,926,510 | B1 | 4/2011 | Terry, III et al. | |
| 8,007,014 | B2 | 8/2011 | Youssef et al. | |
| 8,020,575 | B1 | 9/2011 | Watson | |
| 8,757,671 | B2 | 6/2014 | Pallini, Jr. et al. | |
| 9,080,705 | B2 | 7/2015 | Nezu | |
| 9,350,148 | B2 | 5/2016 | Emanuel | |
| 2003/0037818 | A1 | 2/2003 | Helle | |
| 2004/0262306 | A1 | 12/2004 | Smith | |
| 2007/0228038 | A1 | 10/2007 | Louis | |
| 2008/0041009 | A1 | 2/2008 | Cairo et al. | |
| 2010/0071275 | A1 | 3/2010 | Mathai et al. | |
| 2010/0077677 | A1 | 4/2010 | Floyd et al. | |
| 2011/0036019 | A1 * | 2/2011 | Liao | E02D 29/14 52/19 |
| 2011/0168716 | A1 * | 7/2011 | Stransky | H02G 3/185 220/484 |
| 2011/0262094 | A1 * | 10/2011 | Burke | G02B 6/4442 385/135 |
| 2012/0280163 | A1 | 11/2012 | Lunder | |
| 2013/0294840 | A1 | 11/2013 | Floyd et al. | |
| 2013/0320671 | A1 | 12/2013 | Kramer, Jr. | |
| 2013/0334220 | A1 | 12/2013 | Sohler | |
| 2015/0053278 | A1 | 2/2015 | Mosley et al. | |
| 2015/0291311 | A1 | 10/2015 | Meza Cabello et al. | |
| 2018/0238030 | A1 | 8/2018 | Floyd et al. | |

OTHER PUBLICATIONS

Floyd, Scott P.; Requirement for Restriction/Election for U.S. Appl. No. 15/436,003, filed Feb. 17, 2017, dated Mar. 21, 2018, 9 pgs.

Floyd, Scott P.; Notice of Allowance for U.S. Appl. No. 15/436,003, filed Feb. 17, 2017, dated Oct. 11, 2018, 13 pgs.

* cited by examiner

METHOD OF COUPLING A PIT EXTENSION TO A PIT LINER OF A PIT VAULT

REFERENCE TO RELATED APPLICATIONS

This application is a divisional of U.S. application Ser. No. 15/436,003, filed Feb. 17, 2017, which is hereby specifically incorporated by reference herein in its entirety.

TECHNICAL FIELD

This disclosure relates to equipment pits. More specifically, this disclosure relates to an extension for a pit for meters or other underground equipment.

BACKGROUND

Some municipal water distribution systems or other piping infrastructures include pipes which are buried underground. Pits, or vaults, can be used to facilitate access to underground pipes and equipment, such as water meters, connected to the underground pipes. The pit can comprise a pit liner which can provide a protected and unobtrusive location to house the equipment below ground and out of sight. The pit liner can also maintain accessibility for activities such as maintenance, meter reading, and the removal or installation of equipment through an opening of the pit liner that is positioned level with the surface of the earth. The opening can be covered by a lid in order to provide to protect the equipment. The pit liners are often provided in standard heights; however, the depth of each pit can vary based on the depth of burial of the pipes, the elevation of the surrounding land area, or other contributing factors. In some applications, the burial depth of the pipes can be greater than the height of a standard pit liner.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a pit extension comprising an extension body, the extension body defining an extension bottom end and an extension top end, the extension body defining an extension inner surface and an extension outer surface, the extension inner surface defining an extension bore extending from the extension bottom end to the extension top end; and a plurality of legs, each leg of the plurality of legs comprising an attached portion and an extended portion, the attached portion of each leg attached proximate to the extension bottom end of the extension body, the extended portion of each leg extending downward from the extension bottom end, the extended portion of each leg configured to attach to a top end of a pit liner.

Also disclosed is a pit assembly comprising a pit vault, the pit vault comprising a pit liner, the pit liner defining a liner top end and a liner bottom end, the pit liner defining a liner inner surface and a liner outer surface, the liner inner surface defining a liner bore extending from the liner top end to the liner bottom end; and a pit extension, the pit extension comprising an extension body, the extension body defining an extension bottom end and an extension top end, the extension bottom end positioned in an end-to-end facing relationship with the liner top end, the extension body defining an extension inner surface and an extension outer surface, the extension inner surface defining an extension bore extending from the extension bottom end to the extension top end; and a plurality of legs, each leg of the plurality of legs comprising an attached portion and an extended portion, the attached portion of each leg attached proximate to the extension bottom end of the extension body, the extended portion of each leg attached proximate to the liner top end.

Also disclosed is a method of coupling a pit extension to a pit liner of a pit vault comprising aligning an extension bottom end of the pit extension with a liner top end of the pit liner in an end-to-end facing relationship; bringing a leg of the pit extension into engagement proximate to the liner top end; and attaching the leg to the pit liner.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
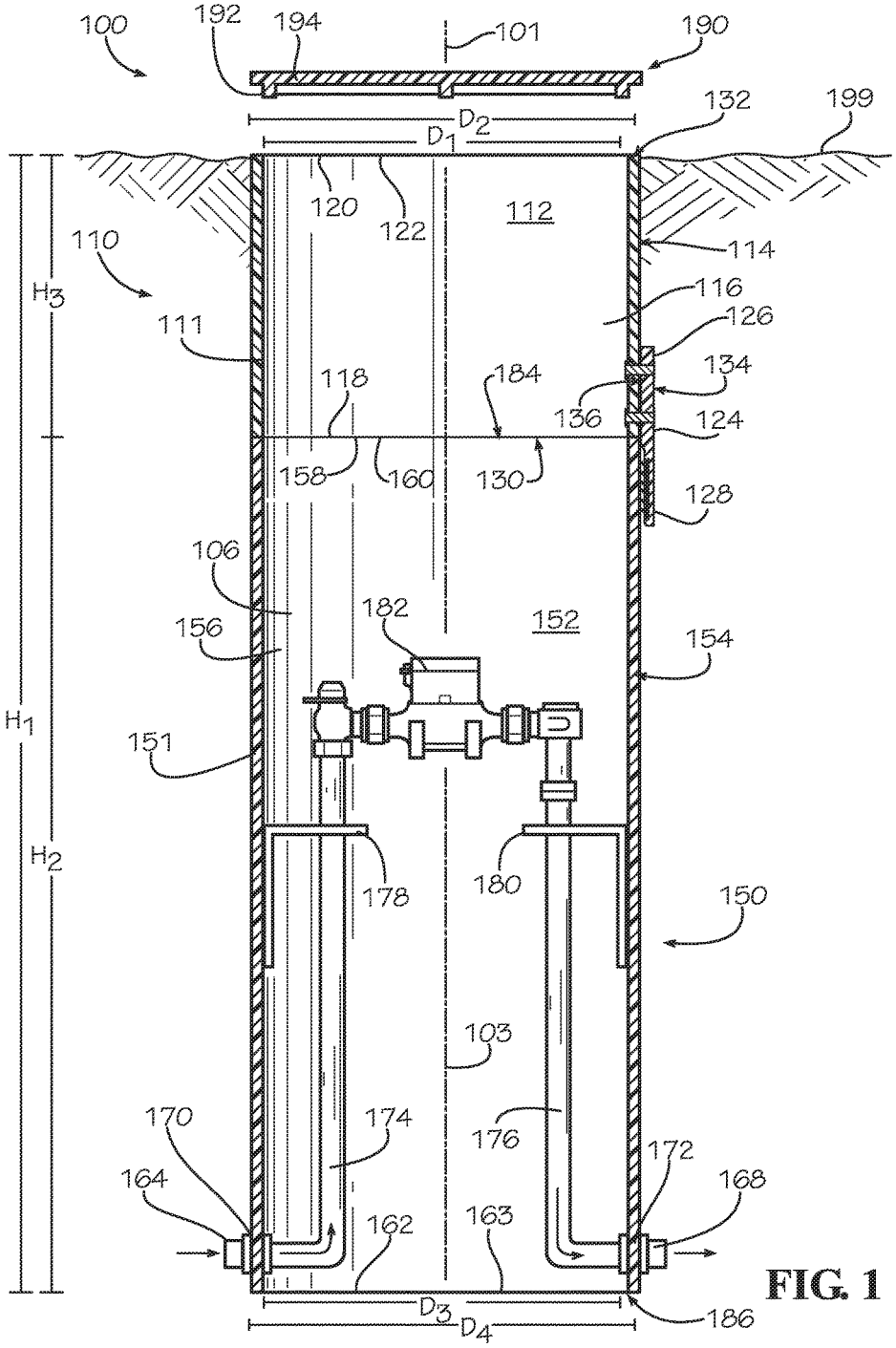
FIG. 1 is a cross-sectional view of a pit assembly comprising a pit extension, a pit vault, and a lid in accordance with one aspect of the disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a pit extension and associated methods, systems, devices, and various apparatus. The pit extension comprises an extension body and a plurality of legs. It would be understood by one of skill in the art that the disclosed pit extension is described in but a few exemplary embodiments among many. No particular terminology or description should be considered limiting on the disclosure or the scope of any claims issuing therefrom.

FIG. 1 shows a cross-section of a pit assembly 100 which can comprise a pit extension 110, a pit vault 150, and a lid 190 in accordance with one aspect of the disclosure. The pit extension 110 can be installed atop the pit vault 150 in an installed position in which an extension bottom end 118 of the pit extension 110 can be positioned in an end-to-end facing relationship with a liner top end 158 of the pit vault 150.

The pit extension 110 can comprise an extension body 111 and a plurality of legs, as represented by a leg 124 in FIG. 1. The extension body 111 can define an extension inner surface 112 and an extension outer surface 114. The extension outer surface 114 can be disposed opposite from the extension inner surface 112. The extension inner surface 112 can define an extension bore 116, and the extension bore 116 can define an extension axis 101. The extension outer surface 114 can face radially outwards with respect to the extension axis 101, and the extension inner surface 112 can face radially inwards with respect to the extension axis 101. The extension inner surface 112 can define an extension inner diameter $D_1$ of the extension body 111, and the extension outer surface 114 can an extension outer diameter $D_2$.

The lid 190 can be positioned covering an extension opening 122 defined by the pit extension 110, and the lid 190 can be configured to seal the pit assembly 100. The lid 190 can comprise an insertion portion 192 sized complimentary to the extension inner diameter $D_1$ such that the insertion portion 192 fits within the extension opening 122, and a rim portion 194 sized greater than the extension inner diameter $D_1$. In the present aspect, the rim portion 194 can define a diameter equal to the extension outer diameter $D_2$; however, in other aspects, the rim portion 194 can be sized larger or smaller than the extension outer diameter $D_2$.

The extension body 111 can define the extension bottom end 118 and an extension top end 120. The extension top end 120 can be disposed opposite from the extension bottom end 118. The extension top end 120 can define an extension top end surface 132 facing axially outwards from the extension body 111 with respect to the extension axis 101. The extension bottom end 118 can define an extension bottom end surface 130 facing axially outwards from the extension body 111 with respect to the extension axis 101, opposite from the extension top end surface 132. The extension top end 120 can define the extension opening 122. The extension body 111 can define a substantially tubular shape with a circular cross-sectional shape; however, in other aspects, the extension body 111 can define a different shape, such as square, rectangular, octagonal, or any other suitable shape.

The pit vault 150 can comprise a pit liner 151. The pit liner 151 can define a substantially tubular shape with a circular cross-sectional shape; however, in other aspects, the pit liner 151 can define a different cross-sectional shape, such as square, rectangular, octagonal, or any other suitable shape. The extension body 111 can define a liner inner surface 152 and a liner outer surface 154. The liner outer surface 154 can be disposed opposite from the liner inner surface 152. The liner inner surface 152 can define a liner bore 156, and the liner bore can define a liner axis 103. The liner outer surface 154 can face radially outwards with respect to the liner axis 103, and the liner inner surface 152 can face radially inwards with respect to the liner axis 103. The liner inner surface 152 can define a liner inner diameter $D_3$ of the pit liner 151, and the liner outer surface 154 can define a liner outer diameter $D_4$ of the pit liner 151. In the present aspect, the extension inner diameter $D_1$ can be substantially equal to the liner inner diameter $D_3$, and the extension outer diameter $D_2$ can be substantially equal to the liner outer diameter $D_4$. In other aspects, the extension inner and outer diameters $D_1$,$D_2$ may not be equal to the respective liner inner and outer diameters $D_3$,$D_4$.

The pit liner 151 can define the liner top end 158 and a liner bottom end 162. The liner bottom end 162 can be disposed opposite from the liner top end 158. The liner top end 158 can define a liner top end surface 184 facing axially outwards from the pit liner 151 with respect to the liner axis 103. The liner top end 158 can define a liner opening 160. The liner bottom end 162 can define a liner bottom end surface 186 facing axially outwards from the pit liner 151 with respect to the liner axis 103, opposite from the liner top end surface 184. In some aspects, a bottom plate (not shown) can be disposed at the liner bottom end 162, and the bottom plate can be configured to cover a bottom opening 163 defined at the liner bottom end 162.

In the present aspect, both the pit liner 151 and the extension body 111 can each comprise polyvinyl chloride (PVC); however, in other aspects, the pit liner 151 and the extension body 111 can comprise other materials such as acrylonitrile butadiene styrene (ABS), polypropylene, polyethylene, polyvinyl chloride, a metal, or any other suitable material. The pit liner 151 can be comprised of different materials from the extension body 111, or the pit liner 151 can be comprised of the same materials as the extension body 111.

With the pit extension 110 installed atop the pit vault 150 in the installed position, the liner top end surface 184 can be positioned in facing contact with the extension bottom end surface 130. In other aspects, the liner top end surface 184 may not directly contact the extension bottom end surface 130. For example, in other aspects, a gasket, adhesive, O-ring, washer, caulking, or other material can be placed between the liner top end surface 184 and the extension bottom end surface 130 to provide a seal between the extension body 111 and the pit liner 151.

In the present aspect, the pit vault 150 can be a Mueller Riser EZ-Setter Meter Box manufactured by Mueller Co., LLC, a subsidiary of Mueller Water Products, Inc., headquartered in Atlanta, Ga., United States; however, the pit extension 110 can be used with any type of pit vault 150. The pit vault 150 can comprise an inlet 164 extending from the liner outer surface 154 to the liner inner surface 152 through an inlet liner conduit 170. The pit vault 150 can also comprise an outlet 168 extending from the liner inner surface 152 to the liner outer surface 154 through an outlet liner conduit 172. The inlet 164 can be connected in fluid communication with an inlet riser piping 174 supported by an inlet piping brace 178, and the outlet 168 can be connected in fluid communication with an outlet riser piping 176 supported by an outlet piping brace 180. Each of the piping braces 178,180 can be attached to the liner inner surface 152 and can support a vertical portion of the respective riser piping 174,176. Equipment 182, which is a water meter in the current aspect, can be installed inline in fluid communication between the inlet riser piping 174 and the outlet riser piping 176. In other aspects, different equipment such as a dechlorinator, a flushing device, a pump, or any other suitable equipment can be housed in the pit vault 150. A fluid, for example and without limitation water, can flow into the pit vault 150 through the inlet 164, up the inlet riser piping 174, through the equipment 182, down the outlet riser piping 176, and out of the pit vault 150 through the outlet 168. In other aspects, the pit vault 150 can comprise multiple inlets 164, multiple outlets 168, or both multiple inlets 164 and outlets 168.

The inlet 164 can be a supply side of a piping infrastructure, such as an underground water distribution system, and the outlet 168 can be a discharge side of the piping infrastructure. In the present aspect, the piping infrastructure can be buried beneath a ground surface 199 at a burial depth $H_1$. In other aspects, such as when the burial depth $H_1$ is relatively shallow, such as 10 to 18 inches, the riser piping 174,176 may not comprise a vertical portion, and the equipment 182 can be positioned horizontally inline between the inlet 164 and the outlet 168. The pit vault 150 can define a height $H_2$ which must equal or exceed the value of the burial depth $H_1$ for the liner opening 160 to be positioned at or above the ground surface 199. If the burial depth $H_1$ exceeds the height $H_2$ of the pit vault 150, the pit extension 110 can be installed atop the pit vault 150 to increase a height of the pit assembly 100 by a distance equal to a height $H_3$ of the extension body 111. The extension body 111 can be sized so that the combined height of the pit vault 150 and the extension body 111 ($H_2$+$H_3$) exceeds or is equal to the burial depth $H_1$.

With the pit extension 110 installed, the extension axis 101 and the liner axis 103 can be aligned, and the extension bore 116 and the liner bore 156 can be coaxial. The extension bore 116 and the liner bore 156 can together define a pit assembly cavity 106 of the pit assembly 100 accessible by a pit assembly opening installed substantially level with or raised above the ground surface 199. Without the pit extension 110 installed, the liner opening 160 can be the pit assembly opening to the pit assembly 100. With the pit extension 110 installed, the extension opening 122 can be the pit assembly opening to the pit assembly 100. It can be undesirable for the pit assembly opening to be positioned below the ground surface 199 because water, dirt, or other debris can flow into the pit assembly cavity 106 when the pit assembly opening is uncovered or can bury the lid 190 when the pit assembly opening is covered.

In the present aspect, the pit extension 110 can be locked to the pit vault 150. The pit extension 110 can comprise a plurality of legs, as represented by the leg 124, which can be attached to the pit extension 110 proximate the extension bottom end 118. Each leg 124 can comprise an attachment portion 126 and an extended portion 128, and each leg 124 can define a radially outer surface 134 and a radially inner surface 136 with respect to the extension axis 101. In the present aspect, the attachment portion 126 can be attached to the extension outer surface 114 of the extension body 111. The extended portion 128 can extend axially outward from the extension body 111 with respect to the extension axis 101, and the extended portion 128 can be configured to axially overlap the liner top end 158 with the radially inner surface 136 of the leg 124 facing the liner outer surface 154. The leg 124 can comprise a plurality of teeth 324 (shown in FIG. 3) which can be disposed on the radially inner surface 136 of the extended portion 128. The plurality of teeth 324 can engage the liner outer surface 154 to lock the pit extension 110 onto the pit vault 150.

Figure 2:
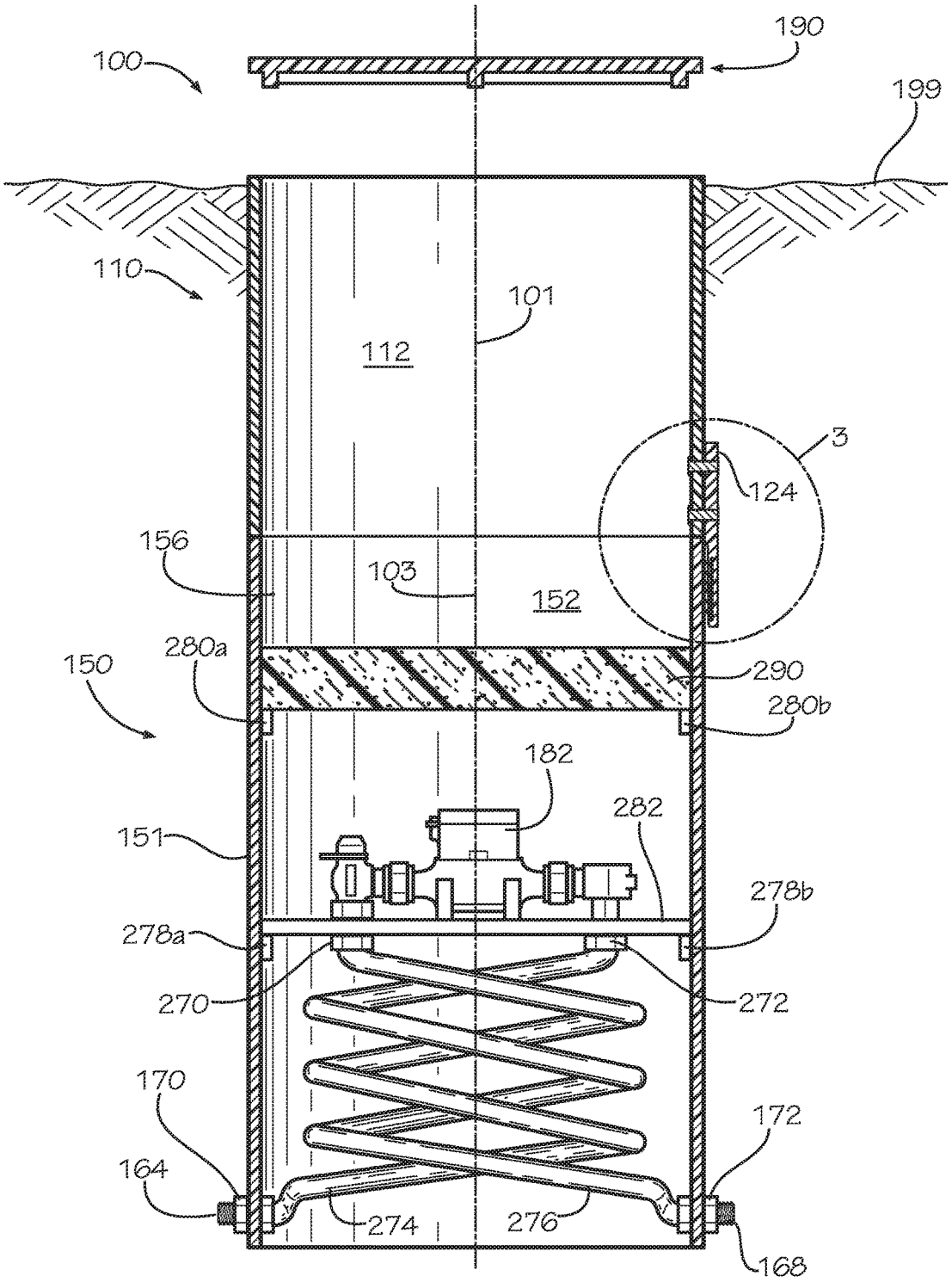
FIG. 2 is a cross-sectional view of the pit extension of FIG. 1 mounted on a pit vault in accordance with another aspect of the disclosure.

FIG. 2 shows a cross-section of the pit extension 110 of FIG. 1 installed on another aspect of the pit vault 150 in accordance with another aspect of the disclosure. As previously discussed, the pit extension 110 can be used with any suitable pit vault 150. In the present aspect, the pit vault 150 can be a Mueller Thermal-Coil Meter Box manufactured by Mueller Water Products, headquartered in Atlanta, Ga., United States. Instead of being supported by the rigid inlet riser piping 174 and outlet riser piping 176, the equipment 182 of the present aspect can be supported by a moveable platform 282 which can be sized complimentary to the liner bore 156. A pair of lower platform stops 278*a,b* and a pair of upper platform stops 280*a,b* can be disposed in the liner bore 156. In the present aspect, the platform stops 278*a,b*, 280*a,b* can be attached to the liner inner surface 152; however, in other aspects, the platform stops 278*a,b*,280*a,b* can be integrally defined by the liner inner surface 152 of the pit liner 151.

As shown, the moveable platform 282 rests upon the lower platform stops 278*a,b*, thereby supporting the equipment 182 in a lower position. A removable insulation pad 290 rests upon the upper platform stops 280*a,b*. The removable insulation pad 290 can be removed from the pit assembly cavity 106, and the moveable platform 282 can also be raised to rest upon the upper platform stops 280*a,b*, thereby supporting the equipment 182 in an upper position. The moveable platform 282 can be selectively moved about and between the upper position and the lower position. The moveable platform 282 is typically positioned in the lower position during operation and can be moved to the upper position when access to the moveable platform 282 and equipment 182 is desired to facilitate maintenance, reading, installation, removal, or any other purpose. In some other aspects, the pit extension 110 can comprise a pair of extension stops (not shown) which can be attached to the extension inner surface 112, and the extension stops can be configured to support the moveable platform 282 in a top position located above the upper position and within or on top of the pit extension 110.

Because the moveable platform 282 and the equipment 182 can be raised and lowered, the equipment 182 is attached to the inlet 164 and the outlet 168 by inlet tubing 274 and outlet tubing 276, respectively. The inlet tubing 274 and the outlet tubing 276 can each be a flexible tubing, such as a poly coil tubing or any other suitable tubing. The inlet tubing 274 can extend from the inlet liner conduit 170 to an inlet platform conduit 270, and the outlet tubing 276 can extend from an outlet platform conduit 272 to the outlet liner conduit 172. The inlet platform conduit 270 and the outlet platform conduit 272 can connect the tubing 274,276, respectively, to the equipment 182 through the moveable platform 282. Each tubing 274,276 can be coiled which can allow each tubing 274,276 to stretch and contract vertically without kinking or pinching the tubing shut, which would thereby obstruct the flow. In the present aspect, the moveable platform 282 supports the equipment 182, which can be the water meter; however, in other aspects, the moveable platform 282 can also support other equipment such as a dechlorinator, a flushing valve, a flushing controller, or any other equipment.

Figure 3:
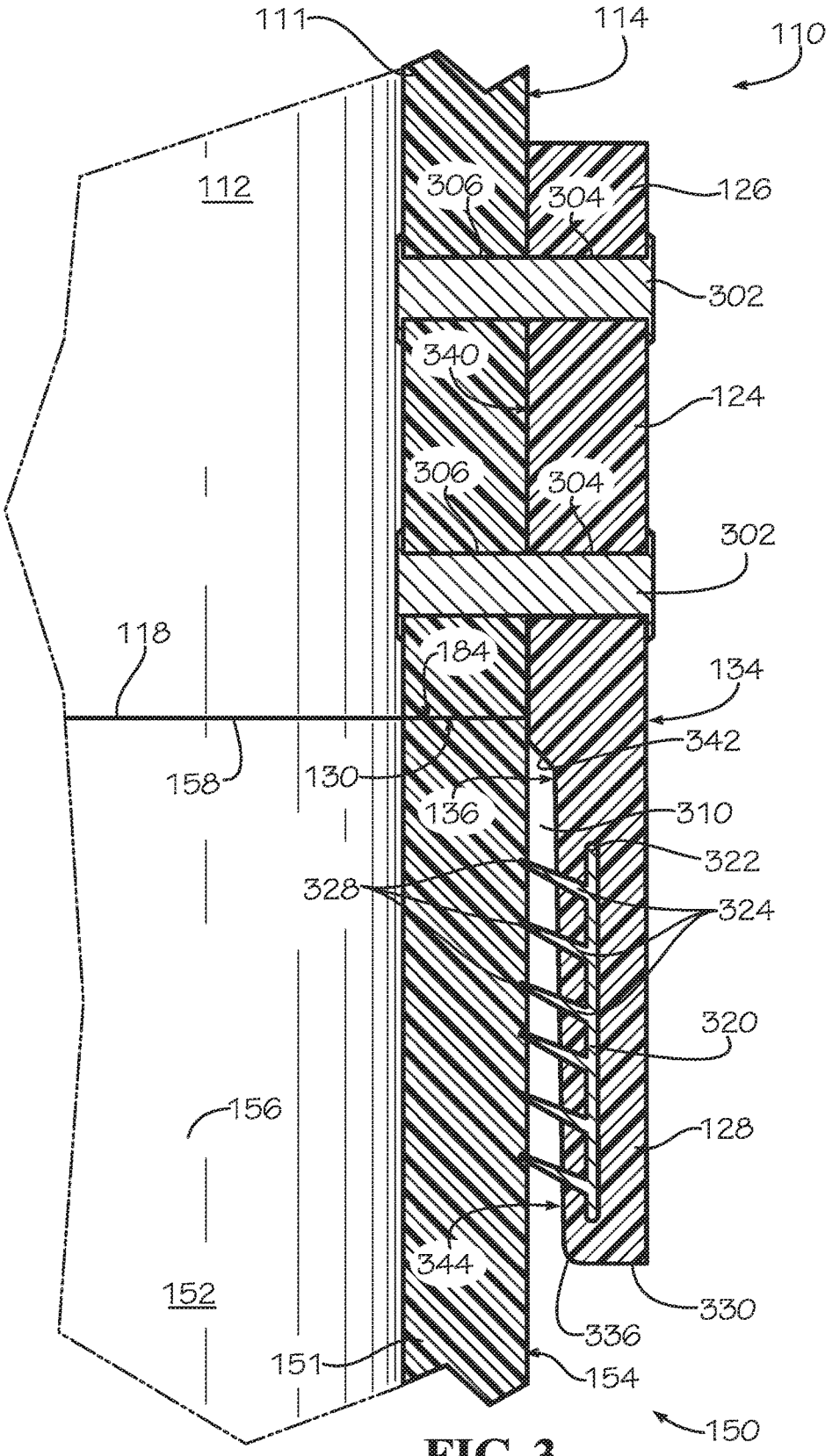
FIG. 3 is a detail view of a leg of the pit extension of FIG. 1 taken from Detail 3 of FIG. 2.

FIG. 3 is a cross-sectional view taken from Detail 3 of FIG. 2. As shown, each leg 124 can comprise a gripping bracket 320. In the aspect shown, the gripping bracket 320 can comprise a plurality of teeth 324 attached to a bracket base 322. The teeth 324 can be arranged in axial columns and circumferential rows with respect to the extension axis 101 or in any other pattern. The teeth 324 shown in the cross-sectional view can define one axial column from six respective circumferential rows. In the present aspect, the gripping bracket 320 can be molded into the extended portion 128 of the leg 124, and the teeth 324 can extend out from the extended portion 128. In the present aspect, the teeth 324 extend radially inward from an extended surface portion 344 of the radially inner surface 136 relative to the extension axis 101. The extended surface portion 344 can be the portion of the radially inner surface 136 defined by the extended portion 128.

Each of the teeth 324 can define an end 328 disposed opposite from the bracket base 322, and with the pit extension 110 installed on the pit vault 150, the ends 328 can engage the liner outer surface 154 of the pit liner 151. In the aspect shown, the ends 328 of the teeth 324 can dig into the liner outer surface 154 in order to prevent removal of the pit extension 110 from the pit vault 150. The teeth 324 can also extend axially inward toward the extension body 111 which can position the teeth 324 at an angle to the liner outer surface 154. The angled orientation of the teeth 324 can bias the teeth 324 to allow for the pit liner 151 to be inserted between the legs 124, but can also bias against removal or withdrawal of the pit liner 151 from between the legs 124. Because of the angled orientation, applying a tension force between the pit extension 110 and the pit vault 150 can cause the teeth 324 to further dig into the liner outer surface 154, thereby resisting removal of the pit extension 110 from the pit vault 150. The plurality of teeth 324 can fix the pit extension 110 axially and rotationally to the pit vault 150.

In other aspects, the teeth 324 may be individually molded into the leg 124, and the teeth 324 may not be connected to a bracket base 322. In other aspects, the gripping bracket 320 can be attached to either the radially inner surface 136 or the radially outer surface 134 of the leg 124 through a method such as fastening, welding, adhering, bonding, cementing, or any other suitable method. In the present aspect, each tooth 324 can define a substantially pointed shape such as a spear tip, a barb, an acute wedge, a pin shape, a pyramid, a trocar, or any other suitable shape.

A gap 310 can be defined between the radially inner surface 136 and the liner outer surface 154. The gap 310 can provide clearance for the teeth 324 to each deform and deflect radially outward upon insertion of the pit liner 151 between the legs 124. The teeth 324 can elastically deform or plastically deform or both elastically and plastically deform. The deflection or deformation can provide a residual force which biases the teeth 324 to press into the liner outer surface 154. The gap 310 can also provide clearance to aid in insertion of the liner top end 158 between the plurality of legs 124. The extended portion 128 of each leg 124 can define a first transition surface 336 defined at an end 330 of the leg 124. The first transition surface 336 can be configured to aid in insertion of the liner top end 158 between the plurality of legs 124. In the present aspect, the first transition surface 336 can be a rounded shoulder; however, in other aspects, the first transition surface 336 can be a bevel, chamfer, or any other suitable contour.

In other aspects, the gap 310 may not be present between the leg 124 and the pit liner 151, and at least a portion of the extended surface portion 344 of the radially inner surface 136 can be in facing contact with the liner outer surface 154. In such embodiments, the teeth 324 can be shorter structures such as pointed pyramids or triangular ridges which are not configured to deflect or deform. Instead, the cantilevered extended portion 128 can deflect or elastically deform relative to the attachment portion 126 which can provide the residual force which biases the teeth 324 to press into the liner outer surface 154. In such aspects, the first transition surface 336 can initiate the deflection of the extended portions 128 when the liner top end 158 is inserted between the legs 124.

In the present aspect, the attachment portion 126 of each leg 124 can be attached to the extension outer surface 114 with fasteners 302. In the present aspect, the fasteners 302 can be rivets; however in other aspects, the fasteners 302 can be screws, bolts, nails, staples, or any other suitable fasteners. The attachment portion 126 can define a plurality of leg fastener bores 304 extending from the radially outer surface 134 to the radially inner surface 136. The extension body 111 can define a plurality of extension fastener bores 306 extending from the extension outer surface 114 to the extension inner surface 112. The leg fastener bores 304 can be aligned with the extension fastener bores 306, and the fasteners 302 can extend through the leg fastener bores 304 and the extension fastener bores 306 to secure each leg 124 to the extension body 111. In other aspects, the attachment portion 126 can be attached to the extension outer surface 114 through a method such as welding, bonding, adhering, or any other suitable method of attachment. In other aspects, the legs 124 can be formed integrally with the extension body 111, such as by casting the extension body 111 and legs 124 as a single body.

An attachment surface portion 340 of the radially inner surface 136 can be shaped complimentary to a curvature of the extension outer surface 114. The attachment surface portion 340 can be a portion of the radially inner surface 136 defined by the attachment portion 126. In the present aspect, the attachment surface portion 340 can be in facing contact with the extension outer surface 114; however, in other aspects, the attachment surface portion 340 may not be in facing contact with the extension outer surface 114, such as when the leg 124 is attached to the extension body 111 with an adhesive. In the present aspect, the attachment surface portion 340 can also be in facing contact with the liner outer surface 154 proximate the liner top end 158. Contact between the attachment surface portion 340 and the liner outer surface 154 can center the pit extension 110 on the pit vault 150. In the present aspect, a second transition surface 342 can be defined between the attachment surface portion 340 and the extended surface portion 344 of the radially inner surface 136. In the present aspect, the second transition surface 342 can be a frustoconical surface configured to guide and center the pit extension 110 on the pit vault 150 when engaging the liner outer surface 154 with the attachment surface portion 340. In other aspects, the attachment surface portion 340 may not contact the liner outer surface 154, and the teeth 324 or a portion of the extended surface portion 344 can center the pit extension 110 on the pit vault 150.

In other aspects, the legs 124 can be attached to the extension inner surface 112, the plurality of teeth 324 can be disposed on the radially outer surface 134 of each leg, and the teeth 324 can be configured to engage the liner inner surface 152. In some other aspects, the pit extension 110 can comprise legs 124 disposed on both the extension inner surface 112 and the extension outer surface 114, and the teeth 324 of the legs 124 can be configured to engage both the liner inner surface 152 and the liner outer surface 154. In some other aspects, instead of teeth 324, the legs 124 can comprise tabs, pegs, or other protrusions configured to engage a groove, such as a circumferential groove, or pockets defined by the liner outer surface 154. In some other aspects, the legs 124 can define pockets, apertures, sockets, or other features configured to engage protrusions disposed on the liner outer surface 154.

In still other aspects, the pit extension 110 can comprise a circumferential collar (not shown) extending around the extension bottom end 118, and an extended portion of the circumferential collar can be configured to either insert into the liner bore 156 and engage the liner inner surface 152 with a plurality of outward-facing teeth or ribs or to encircle the liner top end 158 and engage the liner outer surface 154 with a plurality of inward-facing teeth or ribs. In some aspects, the circumferential collar can comprise a sealing member configured to form a seal between the extension bottom end surface 130 pit extension 110 and the liner top end surface 184 pit vault 150.

Figure 4:
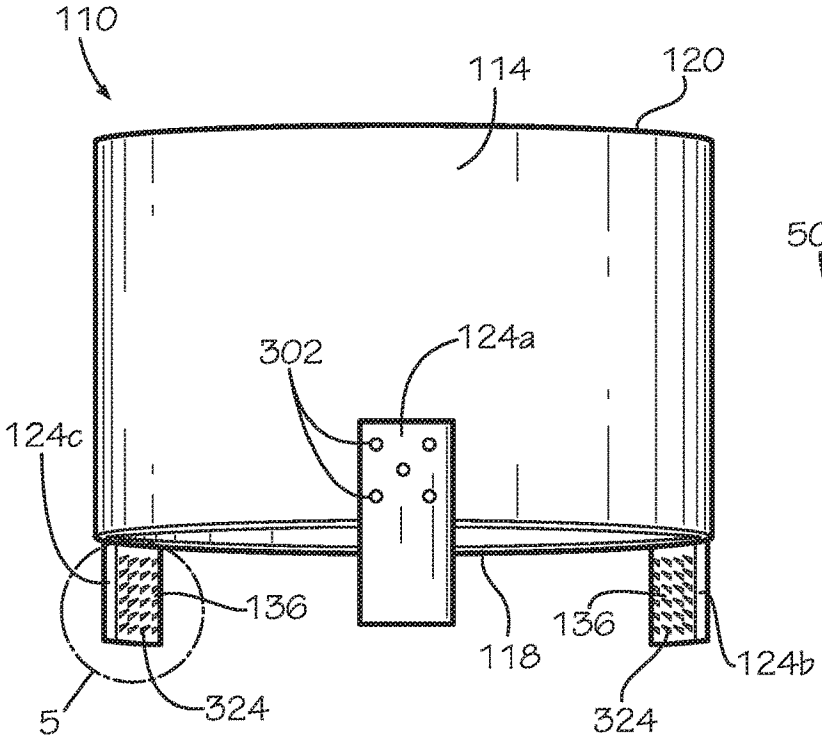
FIG. 4 is a perspective view of the pit extension of FIG. 1.

FIG. 4 shows a perspective view of the pit extension 110 of FIG. 1 wherein the leg 124 is leg 124*a* of the plurality of legs 124*a,b,c*. The legs 124*a,b,c* can be disposed circumferentially around the extension outer surface 114 proximate the extension bottom end 118. In other aspects, the pit extension 110 can comprise greater or fewer than three legs 124*a,b,c*. In the present aspect, the legs 124*a,b,c* can be evenly spaced circumferentially about the extension bottom end 118; however, in other aspects, the legs 124*a,b,c* can be irregularly spaced.

Figure 5B:
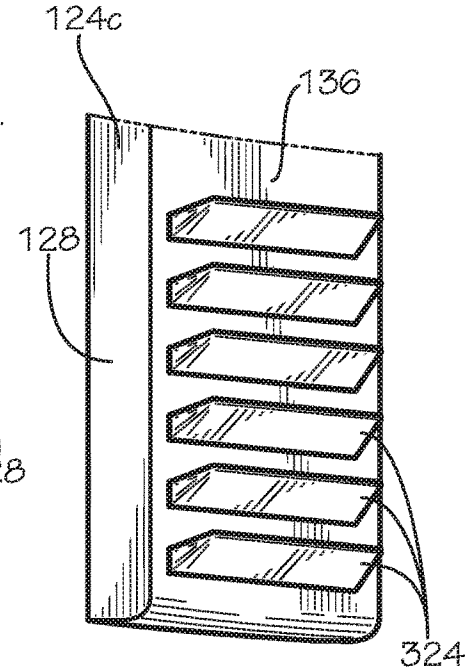
FIG. 5B is a detail view of another aspect of the leg of FIG. 4 taken from Detail 5 of FIG. 4.
Figure 5A:
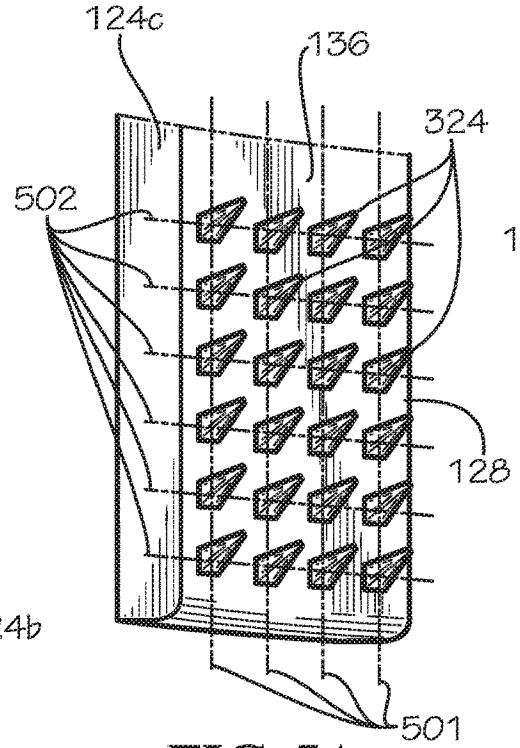
FIG. 5A is a detail view of the leg of FIG. 4 taken from Detail 5 of FIG. 4.

FIG. 5A is a perspective view of the leg 124*c* of FIG. 4 taken from Detail 5 of FIG. 4. In the present aspect, the plurality of teeth 324 are arranged on the radially inner surface 136 of the extend portion 128 of the leg 124*c*. In the present aspect, the teeth 324 can be arranged in four axial columns 501 and six circumferential rows 502; however, the leg 124*c* can comprise any number of teeth 324 in any arrangement. As shown, each of the plurality of teeth 324 can define the pointed shape. The leg 124*c* can be representative of each of the legs 124*a,b,c* of the present aspect.

FIG. 5B is a perspective view another aspect of the leg 124*c* of FIG. 4 taken from Detail 5 of FIG. 4. FIG. 5B shows an alternative configuration for the plurality of teeth 324 wherein each tooth 324 can be a circumferential fin defining an edge instead of a point. In this aspect, the edges can be sharpened as on a knife or razor blade, and the edges can configured to cut into the liner outer surface 154.

Figure 6:
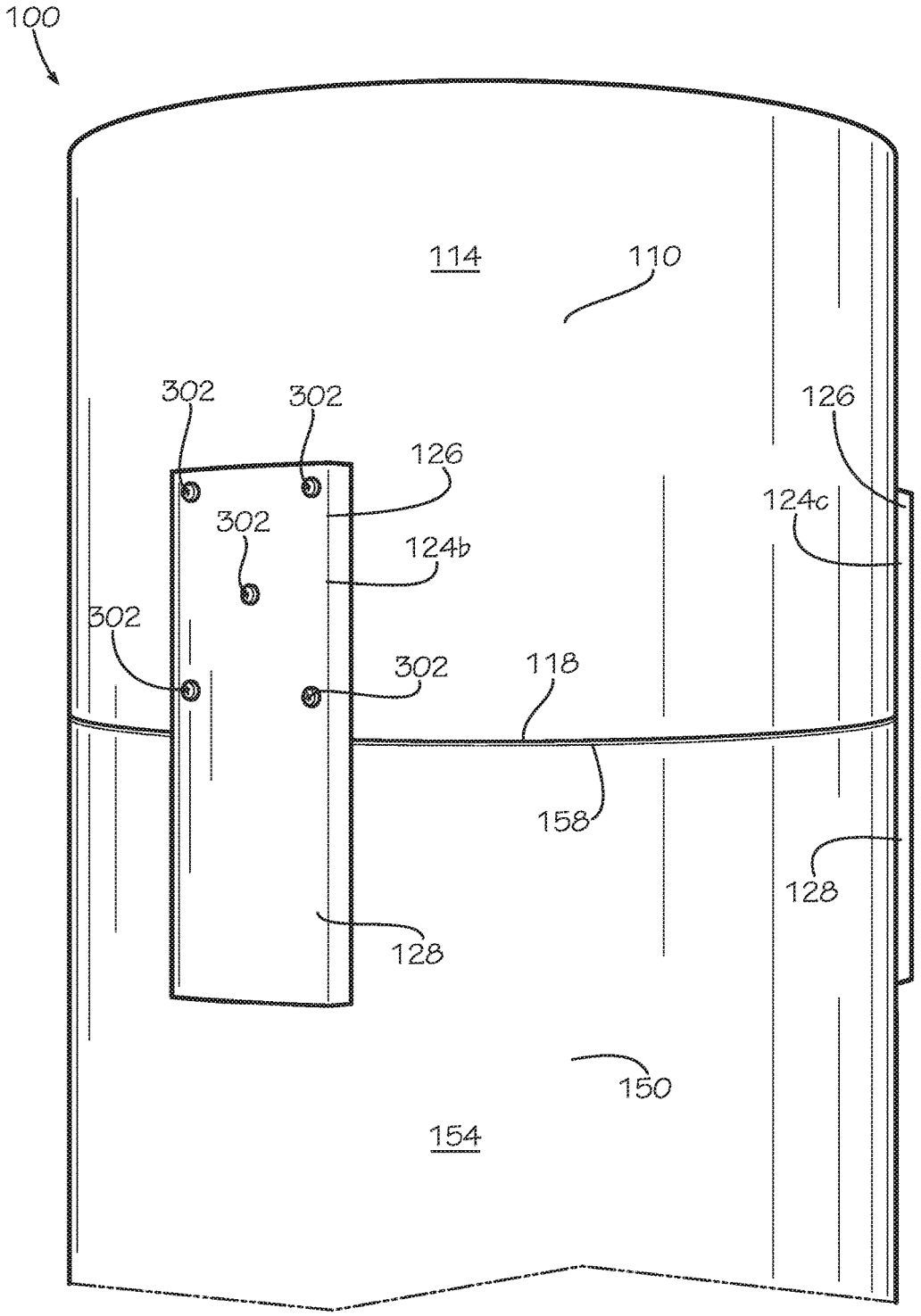
FIG. 6 is a perspective view of the pit assembly of FIG. 1.

FIG. 6 is a perspective view of the pit extension 110 installed on the pit vault 150 with the extension bottom end 118 positioned in an end-to-end facing relationship with the liner top end 158. As shown by the leg 124*b*, the attachment portion 126 of each leg 124 can be attached to the extension outer surface 114 by a plurality of fasteners 302. The extended portion 128 of each leg 124 can axially overlap the liner top end 158 to center and secure the pit extension 110 on the pit vault 150.

Figure 7:
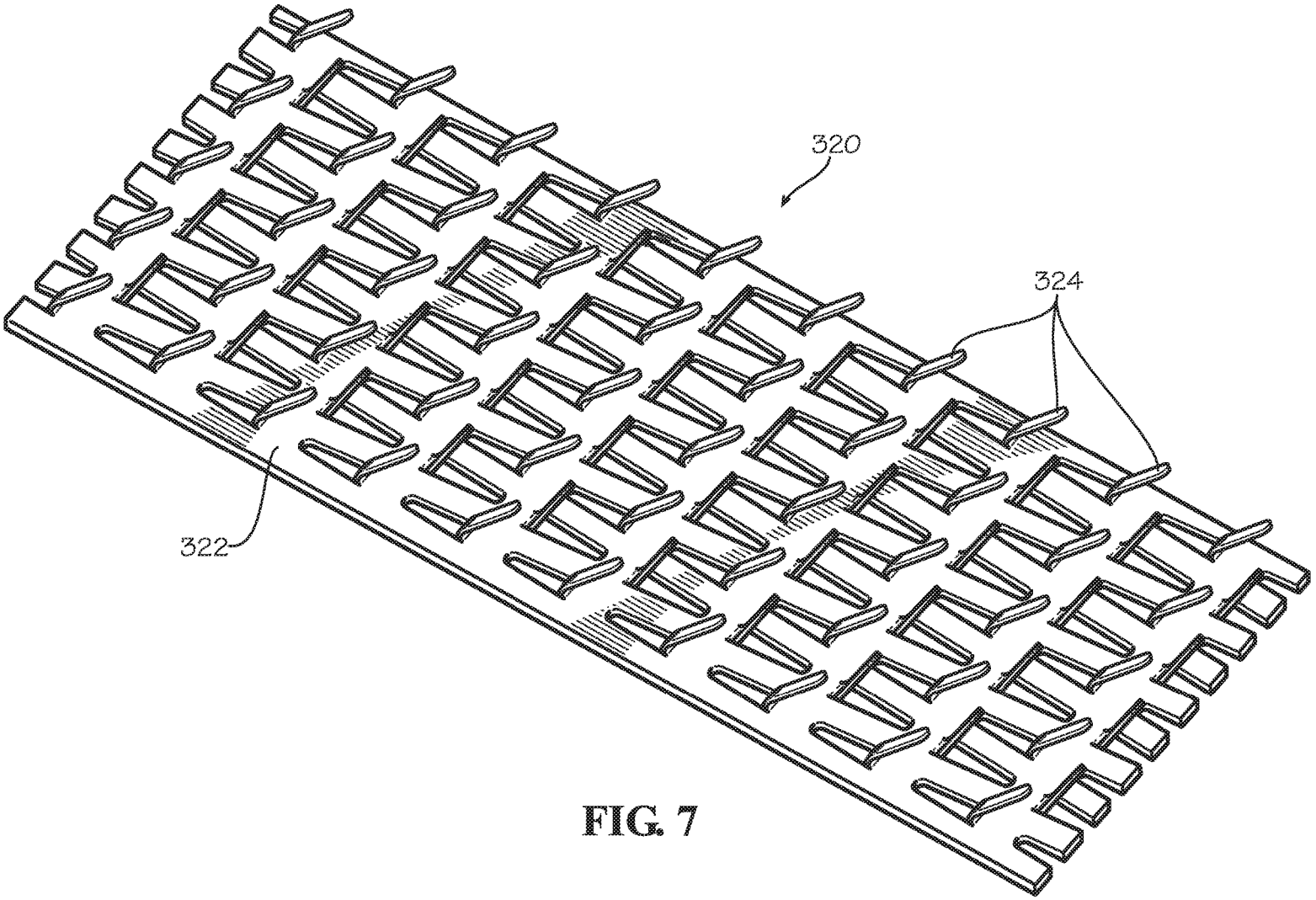
FIG. 7 is a perspective view of one aspect of a gripping bracket in accordance with one aspect of the disclosure.

FIG. 7 is a perspective view of another aspect of the gripping bracket 320. As shown, the gripping bracket 320 can comprise the bracket base 322 and the plurality of teeth

324 extending outwards from the bracket base 322. The number and arrangement of teeth 324 should not be viewed as limiting, and the gripping bracket 320 can comprise any number of teeth 324 of any shape positioned in any arrangement. In the present aspect, the gripping bracket 320 can comprise a metal, such as steel, iron, bronze, aluminum, brass, or any other suitable metal. In the present aspect, the teeth 324 can be formed by die cutting each tooth 324 from the bracket base 322 and bending each tooth outwards from the bracket base 322. In other aspects, the teeth 324 can be attached to the bracket base 322 rather than being formed from the bracket base 322. In other aspects, the gripping bracket 320 can be formed in a casting, forging, machining operation, or any combination thereof. The gripping bracket 320 can be molded into the leg 124 during formation of the leg 124. The bracket base 322 can be configured to anchor the gripping bracket 320 to the leg 124 when molded into the leg 124. In the present aspect, the leg 124 can comprise ABS plastic; however, in other aspects, the legs 124 can comprise a different material such as nylon, acrylic, polythene, polypropylene, polyvinyl chloride, polycarbonate, Bakelite, aluminum, steel, iron, or any other suitable material. In some aspects, the leg 124 and the teeth 324 can comprise the same material, and the teeth 324 can be formed integral to the leg 124.

Figure 8:
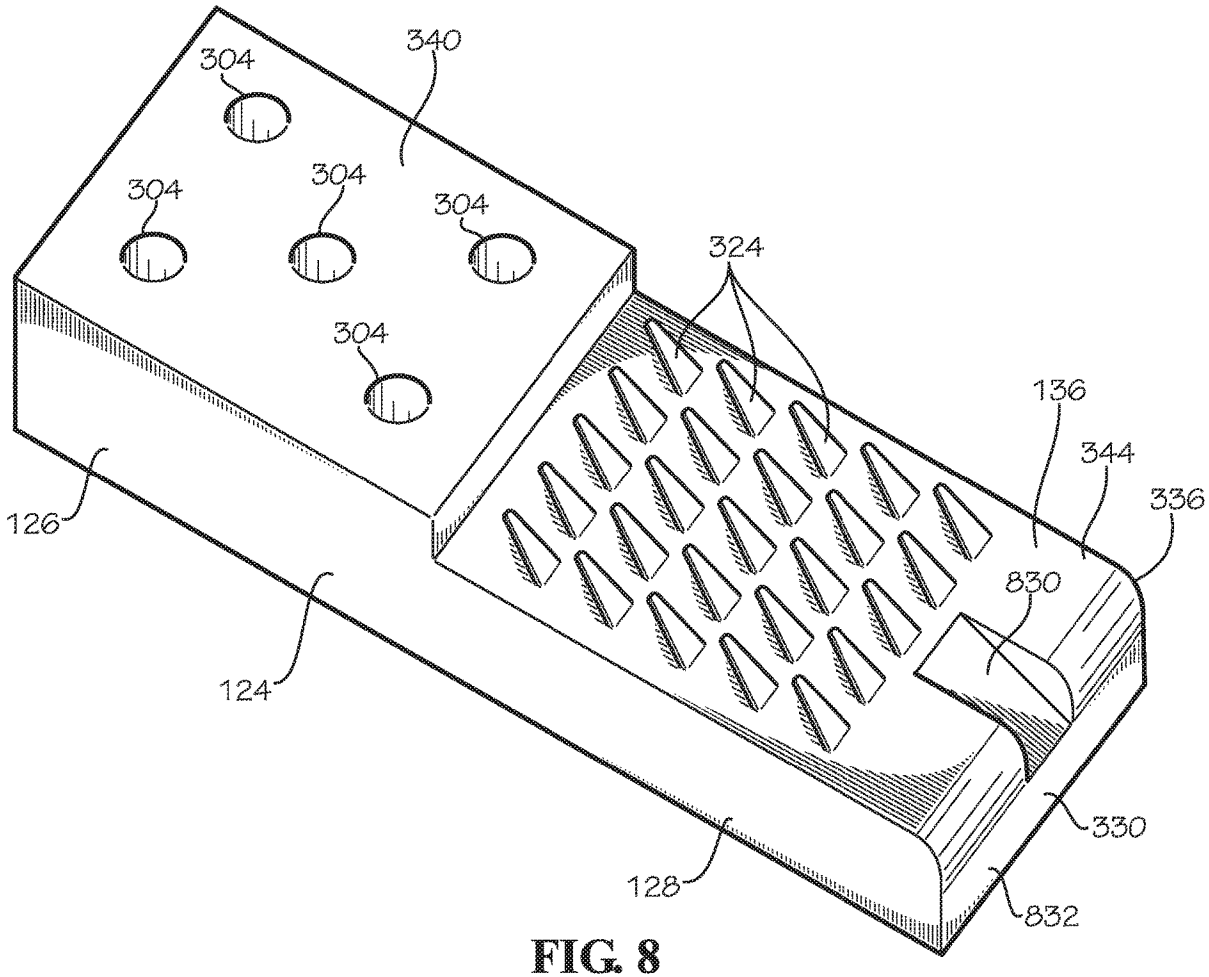
FIG. 8 is a perspective view of a leg in accordance with another aspect of the disclosure.

FIG. 8 shows a perspective view on another aspect of the leg 124 defining an end slot 830. The end slot 830 can be defined into the extended portion 128 of the leg 124. The end slot can extend between the extended surface portion 344 of the radially inner surface 136 to an end surface 832 defined by the end 330. The end slot 830 can be defined into the extended portion 128 below the first transition surface 336. When the pit extension 110 is installed on the pit vault 150, the plurality of teeth 324 can engage the liner outer surface 154, preventing removal under tension of the pit extension 110 from the pit vault 150. The end slot 830 provides clearance for a tool, such as a screwdriver blade, pry bar, wedge, key, or specialized tool, to be inserted between the extended portion 128 and the liner outer surface 154 to allow the extended portion 128 to be bent away from the liner outer surface 154. Bending the extended portion 128 radially outward from the liner outer surface 154 can disengage the plurality of teeth 324 from the liner outer surface 154, thereby facilitating removal of the pit extension 110 from the pit vault 150.

A method of coupling the pit extension 110 to the pit liner 151 of the pit vault 150 can comprise aligning the extension bottom end 118 of the pit extension 110 with the liner top end 158 of the pit liner 151 in an end-to-end facing relationship, overlapping the leg 124 of the pit extension 110 with the liner top end 158, and engaging the tooth 324 of the leg 124 with the pit liner 151. The pit liner 151 can define the liner inner surface 152 and the liner outer surface 154, and engaging the tooth 324 of the leg 124 with the pit liner 151 can comprise engaging the tooth 324 with the liner outer surface 154. Aligning the extension bottom end 118 with the liner top end 158 can comprise aligning the extension axis 101 defined by the pit extension 110 with the liner axis 103 defined by the pit liner 151, and contacting the extension bottom end surface 130 with the liner top end surface 184 in facing contact. The method can further comprise elastically deforming the leg 124. The method can further comprise elastically deforming the tooth 324.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A method of coupling a pit extension to a pit liner of a pit vault comprising:

aligning an extension bottom end of the pit extension with a liner top end of the pit liner in an end-to-end facing relationship, the pit liner defining a liner inner surface and a liner outer surface;

bringing a leg of the pit extension into engagement with the pit liner proximate to the liner top end, wherein bringing the leg of the pit extension into engagement with the pit liner comprises engaging a tooth defined on the leg with the liner outer surface;

plastically deforming the tooth; and attaching the leg to the pit liner.

2. The method of claim 1, wherein plastically deforming the tooth comprises deflecting the tooth radially outward relative to an extension axis defined by the pit extension.

3. The method of claim 1, further comprising digging the tooth into the liner outer surface.

4. The method of claim 1, wherein aligning the extension bottom end with the liner top end comprises:

aligning an extension axis defined by the pit extension with a liner axis defined by the pit liner; and contacting an extension bottom end surface with a liner top end surface in facing contact.

5. The method of claim 4, further comprising axially overlapping an extended portion of the leg with the liner top end.

6. The method of claim 1, further comprising deforming the leg.

7. The method of claim 6, wherein deforming the leg comprises elastically deforming the leg.

8. The method of claim 1, further comprising guiding and centering the pit extension on the pit vault.

9. The method of claim 8, wherein guiding and centering the pit extension on the pit vault comprises engaging a transition surface defined by the leg with the liner top end of the pit liner.

10. The method of claim 8, wherein guiding and centering the pit extension on the pit vault comprises engaging the liner outer surface of the pit liner with an attachment surface portion of the leg.

11. The method of claim 1, wherein the leg is a first leg, and wherein aligning an extension bottom end of the pit extension with a liner top end of the pit liner in an end-to-end facing relationship comprises positioning the liner top end between the first leg and a second leg of the pit extension.

12. A method of coupling a pit extension to a pit liner of a pit vault comprising:

aligning an extension bottom end of the pit extension with a liner top end of the pit liner in an end-to-end facing relationship, the pit extension comprising an extension body and a leg, the leg attached to an extension outer surface of the extension body;

bringing the leg of the pit extension into engagement with the pit liner proximate to the liner top end;

engaging a tooth with the pit liner, the tooth disposed on an inward-facing surface of the leg; and attaching the leg to the pit liner.

13. The method of claim 12, wherein the tooth is one of a plurality of teeth disposed on the inward-facing surface of the leg.

14. The method of claim 12, wherein engaging the tooth with the pit liner comprises engaging the tooth with a liner outer surface of the pit liner.

15. The method of claim 12, wherein engaging the tooth with the pit liner comprises digging the tooth into a liner outer surface of the pit liner.

16. The method of claim 12, further comprising deforming the tooth.

17. A method of coupling a pit extension to a pit liner of a pit vault comprising:

aligning an extension bottom end of the pit extension with a liner top end of the pit liner in an end-to-end facing relationship;

bringing a leg of the pit extension into engagement with the pit liner proximate to the liner top end, a plurality of teeth attached to a bracket base, the plurality of teeth being die cut from the bracket base, the plurality of teeth and the bracket base being molded into the leg;

engaging a tooth of the plurality of teeth with the pit liner;

attaching the leg to the pit liner.

18. The method of claim 17, further comprising deflecting the tooth radially outward relative to an extension axis defined by the pit extension.

19. The method of claim 17, wherein the tooth is disposed on an inward-facing surface of the leg.

20. The method of claim 17, further comprising axially overlapping an extended portion of the leg with the liner top end.

* * * * *